US009290192B2

(12) United States Patent
Click et al.

(10) Patent No.: US 9,290,192 B2
(45) Date of Patent: Mar. 22, 2016

(54) SPRING WING CONTROLLER

(71) Applicant: voestalpine Nortrak Inc., Cheyenne, WY (US)

(72) Inventors: Gary Click, Birmingham, AL (US); Brent Duffner, Pinson, AL (US); Bradley Smith, Pell City, AL (US); Martin Webb, Richmond (CA)

(73) Assignee: Voestalpine Nortrak Inc., Cheyenne, WY (US)

( * ) Notice: Subject to any disclaimer, the term of this patent is extended or adjusted under 35 U.S.C. 154(b) by 286 days.

(21) Appl. No.: 14/103,738

(22) Filed: Dec. 11, 2013

(65) Prior Publication Data

US 2015/0159332 A1 Jun. 11, 2015

(51) Int. Cl.
*B61L 5/04* (2006.01)
*E01B 7/14* (2006.01)

(52) U.S. Cl.
CPC .... *B61L 5/04* (2013.01); *E01B 7/14* (2013.01)

(58) Field of Classification Search
CPC ..... E01B 7/00; E01B 7/02; E01B 7/04; E01B 7/06; E01B 7/10; E01B 7/14; B61L 5/04; B61L 5/045
USPC ..... 246/382, 468
See application file for complete search history.

(56) References Cited

U.S. PATENT DOCUMENTS 514,630 A * 2/1894 Stewart et al. ..... E01B 7/14 246/276
529,168 A * 11/1894 Hansel ..... B61L 5/04 246/158
1,689,841 A 10/1928 Powell
2,036,198 A 4/1936 Cooper et al.
2,405,407 A 8/1946 Conley
2,686,668 A 8/1954 Bettison
4,362,282 A 12/1982 Frank
4,624,428 A 11/1986 Frank
4,637,578 A 1/1987 Frank
5,806,810 A * 9/1998 Young ..... B61L 11/02 246/257
5,810,298 A 9/1998 Young et al.
6,158,697 A 12/2000 Young et al.
6,164,602 A 12/2000 Kuhn et al.

(Continued)

FOREIGN PATENT DOCUMENTS

CA 2339694 A1 9/2001
FR 2236118 A2 1/1975
WO 01/85524 A2 11/2001

OTHER PUBLICATIONS

Blueprint entitled "Hydraulic Retarder for Spring Rail Frogs," T-12-20, dated Sep. 14, 1948.

*Primary Examiner* — Zachary Kuhfuss
(74) *Attorney, Agent, or Firm* — Marger Johnson

(57) ABSTRACT

A controller for a spring wing on a frog that utilizes a floating piston rod carrying a fixed piston valve and a free-moving piston head is provided. When the piston rod is actuated by the opening movement of the spring wing, the piston valve separates from the piston head briefly, allowing oil to flow through the piston head in a relatively unrestricted manner. The piston head is spring biased towards the piston valve; upon contact between the piston head and the piston valve, the oil flow through the piston head stops, helping to hold the spring wing in the open position. When the spring wing begins to close, the adjustable oil flow through the controller allows the piston rod to move at a controlled rate, thereby controlling the closure rate of the spring wing.

19 Claims, 5 Drawing Sheets

(56) References Cited

U.S. PATENT DOCUMENTS

| | | | |
|---|---|---|---|
| 6,224,023 | B1 | 5/2001 | Young et al. |
| 6,276,642 | B1 | 8/2001 | Young et al. |
| 6,286,791 | B1 | 9/2001 | Young et al. |
| 7,168,663 | B2 | 1/2007 | Schnedl |
| 7,300,023 | B2 | 11/2007 | Biagiotti |
| 7,377,471 | B1 | 5/2008 | Compton et al. |

* cited by examiner

SPRING WING CONTROLLER

FIELD OF THE INVENTION

This invention relates to a device to control the movement of a spring wing. In particular, this invention relates to a device comprising a hydraulic system to control the movement of a spring wing on a frog.

BACKGROUND OF THE INVENTION

A frog is used in a railway where two rails cross over each other, to provide support for the wheels as they pass over the intersection. A spring wing or spring rail frog has a movable wing rail that is connected only at one end, such that it moves laterally away from the frog to provide a flangeway when a wheel of a passing car engages the spring wing rail. Examples of basic spring wing frogs are described in U.S. Pat. Nos. 4,624,428 and 4,637,578, both to Frank.

A common problem with spring wing frogs is that if the spring wing closes quickly, as compared to the speed of the passing train, it may close after each wheel or between cars, and then be forced open again for the next wheel. In this case, the spring wing is subjected to a greater number of cycles in a given time frame, and is therefore susceptible to failure more rapidly. It is therefore preferable to provide a system in which the rate of closure can be controlled, so that a certain amount of time can be expected to elapse after each car wheel passes, before a spring wing is completely closed. In this manner, a spring wing may be expected to stay open until an entire train has passed, rather than constantly opening and closing as the train passes.

U.S. Pat. Nos. 6,158,697 and 5,806,810, both to Young et al., disclose latch holdback mechanisms (either physical or magnetic) designed to hold the spring wing in an open position for a given length of time. Hydraulic fluid is pumped through the system to engage the latch mechanism and hold the spring wing open each time car wheels pass, and bleeds off gradually to release the latch once the wheels have ceased passing. U.S. Pat. No. 2,405,407 to Conley discloses a piston rod within an oil-filled cylinder and a spring connecting the piston and the cylinder. The movement of the piston rod upon opening the spring wing compresses the spring. Movement of the piston further opens a valve on the piston, allowing oil to pass through the valves and hold the piston in an open position. A slow oil leak through a small hole in the valve allows gradual pressure equalization within the cylinder so that the piston and spring wing return to the closed position some time after the last car wheel has passed. PCT Publication No. WO 01/85524 to Moscato et al. discloses a more complex system having three fluid chambers and four fluid flow regulators, in which a hydraulic timing device or similar controller uses a restrictor valve to move the controller at a linearly varying rate depending on the position of the spring wing rail. That is, when the rail is open, the rate of closure is relatively slow, which prevents the rail from closing before the next set of car wheels passes. To avoid excessively slow closure, a relief port is provided, which circumvents the restrictor valve and allows the spring wing to close at a faster rate once it nears its home position. A high pressure relief valve is also provided to protect the timing device from excessively high pressures within the chambers.

However, a further consideration is that once the spring wing is released by the passing car wheel, it is biased to return to its original position and can do so very quickly, slamming against the side of the frog and causing noise and damage or wear to the spring wing and the frog. It is therefore preferable to provide a system that retards the movement of the spring wing, so that it closes more gently against the side of the frog, minimizing the chances that the frog or spring wing will be damaged by the impact. U.S. Pat. No. 2,036,198 to Cooper discloses a dash pot arrangement to automatically control the spring wing movement and allow it to return to a closed position in a gentler manner.

Hydraulic cylinders have been seen as a good way to deal with both controlling the speed and timing of the spring wing closure. In most systems, the piston rod is connected to the spring wing and moves the piston in the cylinder as the spring wing opens, which causes a pressure change within the cylinder. Similar to Conley, U.S. Pat. No. 1,689,841 to Powell provides a by-pass groove in the cylinder wall to allow graduated oil flow during the piston stroke, to control the movement of switch points. In U.S. Pat. No. 2,686,668 to Bettison, a sliding valve is free to move a short distance along the piston rod between the piston head and a shoulder on the piston rod. Movement of the valve covers and uncovers openings in the piston head, such that oil flows to the correct side of the cylinder to control movement of the piston rod and spring wing. Other earlier systems use a similar mechanism, wherein the pressure change causes a check valve to open, which allows fluid to transit from the pressurized side of the piston to the slightly lower pressure rod side of the piston. The volume of the fluid transiting the piston requires more space than the space created by the piston movement and a compressible gas, typically nitrogen, is provided in cylinder to compensate for the difference in volume between the two sides of the cylinder for a given movement of the piston. Once the piston is fully displaced and starts to return to its original position, the pressurization reverses and the fluid on the rod side of the piston increases, closing the check valve. The hydraulic fluid is then slowly bled from the rod side to the non-rod side of the cylinder, for example with a metering jet or other orifice, allowing the spring wing to close in a controlled manner.

However, hydraulic cylinders are susceptible to several potential problems. Any small openings through which fluid is expected to pass may be subject to erosion and plugging due to contaminants in the fluid. Components such as the metering jet are not replaceable, and may fail. Further, such components, or any grooves or other orifices within the hydraulic cylinder, are not adjustable, so the closure speed and timing cannot be changed, for example for different train speed limits mandated by different locations.

Another potential drawback is hydraulic fluid leakage—if the fluid within the cylinder leaks, the cylinder will eventually have insufficient fluid and will not operate properly. The hydraulic retarder disclosed in U.S. Pat. No. 2,686,668 to Bettison includes a pathway between an oil reservoir and the likeliest area of the cylinder to leak, such that any leakage is pulled back into the reservoir and can be returned to the cylinder.

Even if there is sufficient fluid within the cylinder, hydraulic cylinders may still be susceptible to hydrolocking. The piston will always try to travel its full stroke through a cylinder, but if the spring wing moves very quickly, it forces the piston rod to likewise move very quickly. If the hydraulic fluid is unable to transit quickly enough through the check valve or any other openings, which tend to be relatively small and restrictive, the non-rod side of the cylinder will be too full of incompressible fluid, which prevents the rod from travelling far enough and causes it to buckle. The resulting piston rod distortion results in misalignment of the check valves and causes a functional failure, if not a complete structural failure.

It is therefore an object of this invention to provide a mechanism to control the movement of the spring wing on a frog that overcomes some or all of the foregoing difficulties.

It is a further object of the invention to provide a spring wing controller that can respond quickly to the movement of the spring wing, with reduced chance of failure due to the rapid movement of the spring wing.

It is a further object of the invention to provide a control mechanism for a spring wing that is adjustable for various operating conditions.

These and other objects of the invention will be better understood by reference to the detailed description of the preferred embodiment which follows. Note that the objects referred to above are statements of what motivated the invention rather than promises. Not all of the objects are necessarily met by all embodiments of the invention described below or by the invention defined by each of the claims.

SUMMARY

In one aspect, the invention comprises a controller for a spring wing that utilizes a floating piston rod carrying a fixed piston valve, and a free-moving piston head. The piston head is spring biased towards the valve. When the piston rod is actuated by the opening movement of the spring wing, the piston valve separates from the piston head briefly, allowing oil to flow in a relatively unrestricted manner and minimizing pressure spikes and oil cavitation within the controller. The spring movement urges the piston towards the valve, stopping the oil flow and helping to hold the spring wing in place. When the spring wing closes, the oil flow through the controller, which is adjustably set, allows the piston rod to move at a controlled rate, thereby controlling the closure rate of the spring wing.

In one aspect, the invention comprises a controller for a spring wing on a frog, comprising a casing comprising a body having front and rear end caps to define a piston chamber; a piston rod operatively connected to and actuated by the spring wing, the piston rod passing through openings in the front and rear end caps; a floating piston head having a central opening through which the piston rod passes; and a piston valve operatively attached to the piston rod and adapted to close the central opening.

In a further aspect, the controller may also comprise a fluid reservoir in fluid communication with the piston chamber, and a metering device to control fluid flow between the piston chamber and the fluid reservoir. A filter may be provided between the fluid reservoir and the piston chamber and/or within the fluid reservoir. The fluid reservoir may also be provided with a removable cover for external access. The metering device is preferably adjustable.

In yet a further aspect, one or both of the openings in the end caps may comprise one or more of a rod wiper to clean the piston rod, a seal to prevent contaminants from entering the piston chamber or to prevent fluid from exiting the piston chamber and/or a support to support the piston rod.

In yet further aspects, the controller may comprise a spring mounted on the front end cap to bias the piston head away from the front end cap. The rear end cap may comprise a connector to connect the casing in a switch.

In another aspect, the invention comprises a method of controlling a spring wing on a frog, comprising the steps of providing a controller comprising a body having front and rear end caps to define a piston chamber, and a piston rod passing through the front and rear end caps; actuating the piston rod and a piston valve operatively connected to the piston rod toward the rear end cap, by movement of the spring wing to an open position, thereby separating the piston valve from contact with a floating piston head, exposing a central opening in the piston head and allowing hydraulic fluid within the piston chamber to pass through the central opening; moving the floating piston head toward the rear end cap into contact with the piston valve, thereby closing the central opening; and actuating the piston rod, the piston valve and the piston head toward the front end cap, by movement of the spring wing to a closed position. The floating piston head may be moved toward the piston valve by releasing a spring mounted between the front end cap and the piston head.

In a further aspect the method may comprise the step of controlling fluid flow within the piston chamber to control a rate at which the spring wing moves to the closed position. This may be done by providing a fluid reservoir and a metering device in the controller, and controlling fluid flow may comprise using the metering device to control fluid flow between the piston chamber and the fluid reservoir. The fluid may also be filtered within the fluid reservoir and/or between the fluid reservoir and the piston chamber. Contaminants within the fluid may also be allowed to settle within the fluid reservoir.

The foregoing was intended as a summary only and of only some of the aspects of the invention. It was not intended to define the limits or requirements of the invention. Other aspects of the invention will be appreciated by reference to the detailed description of the preferred embodiments. Moreover, this summary should be read as though the claims were incorporated herein for completeness.

BRIEF DESCRIPTION OF THE DRAWINGS

The invention will be described by reference to the detailed description of the preferred embodiment and to the drawings thereof in which.

DETAILED DESCRIPTION

Figure 1:
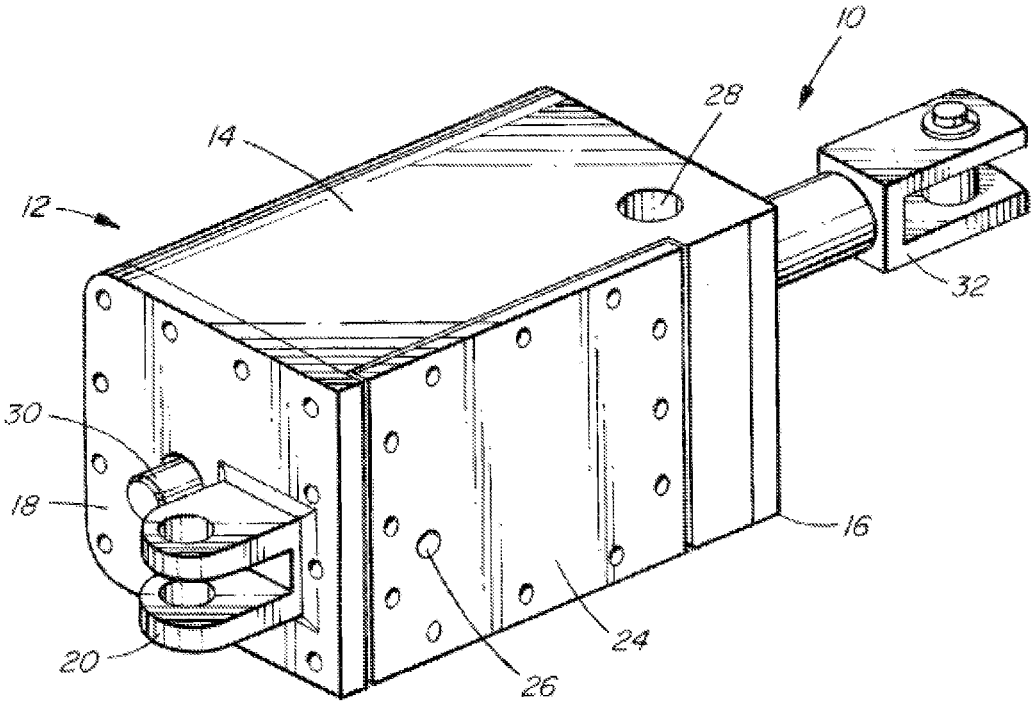
FIG. 1 is a perspective view of the controller of the invention.

Referring to FIG. 1, the controller 10 of the invention comprises a casing 12 having a body 14 capped by front 16 and rear 18 end caps. A rear end cap 18 may be provided with a connecting mechanism 20 of any suitable configuration, to securely attach the controller 10 in place in the switch. In this context, the words "caps" does not necessarily require that the front and rear ends of the body 14 be separate pieces; the body 14 may be formed with integral front and/or rear portions. The body 14 may itself also be formed of one or more pieces.

An internal fluid reservoir 22 (shown only in FIG. 5), which is preferably covered by a removable cover 24 and provided with a fill valve 26, is also provided to hold a hydraulic fluid, such as oil or other suitable incompressible fluid. A fluid flow metering device, which is preferably externally accessible, such as via a cavity 28, is also provided to allow control and adjustment of the fluid flow through the controller 10, as will be discussed later.

A piston rod 30 is provided that preferably passes through both the front 16 and rear 18 end caps. A clevis 32 or similar attachment mechanism may be provided on the end of the rod nearest the frog, to ensure that movement of the spring wing is accurately translated to the piston rod 20.

Figure 2:
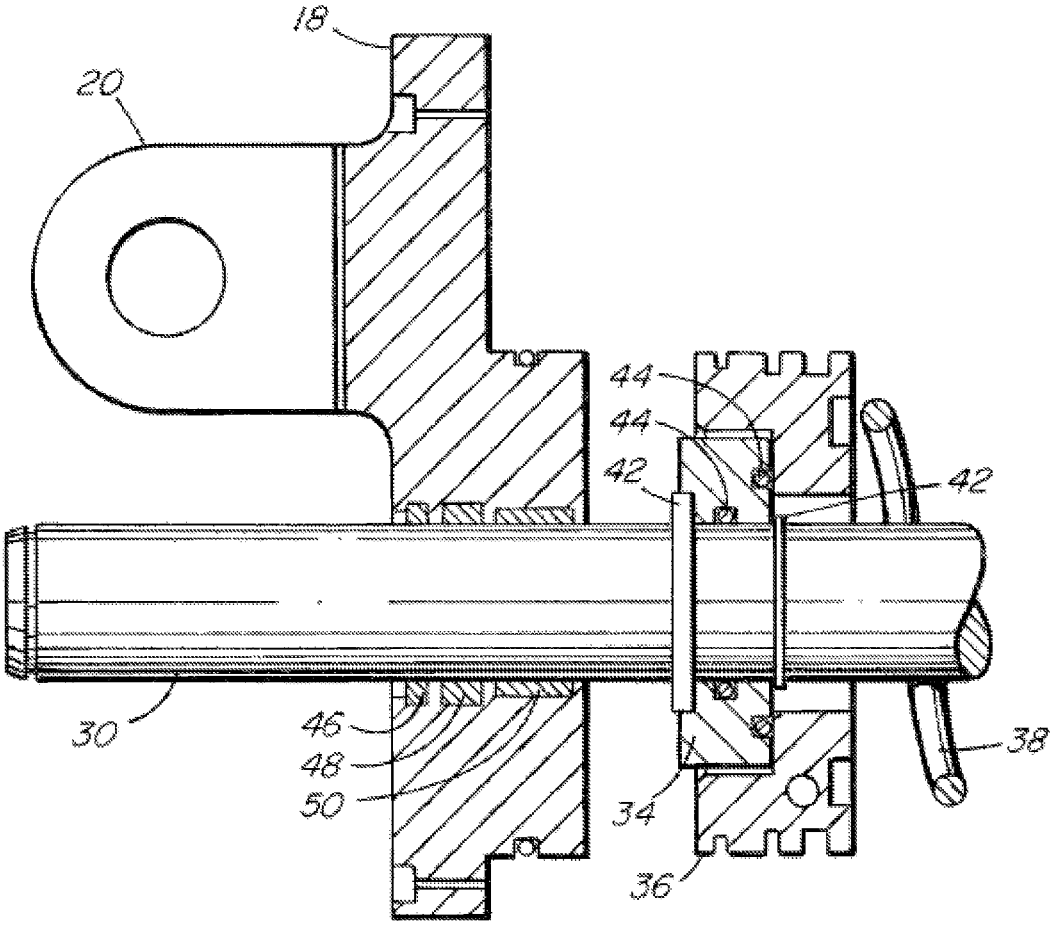
FIG. 2 is a cross sectional view of the rear end of the controller.

Referring now to FIG. 2, the internal parts of the controller 10 comprise a piston valve 34, a piston head 36 and a spring 38. The piston valve 34 is operatively attached to the piston rod 30, via suitable means such as one or more retainers 42; movement of the piston rod towards either the rear 18 or front 16 (not shown) end cap therefore also moves the piston valve 34 in the same direction and by the same amount. Piston head 36 has a central opening 40 through which piston rod 30 passes. Piston head 36 is floating, not attached to the piston rod 30, and central opening 40 of the piston head 36 is sized to provide a gap between the inside surface of the central opening 40 and the outside surface of the piston rod 30. Piston head 36 and piston valve 34 are separable, but able to contact each other such that while the piston valve 34 and piston head 36 are together, the piston valve 34 closes the central opening 40. Valve 34 may fit snugly within central opening 40 or may extend outside central opening 40, as long as the central opening 40 is essentially closed, restricting fluid flow through central opening 40 when piston head 36 and piston valve 34 are in contact. Valve 34 may also be provided with one or more seals 44 to ensure that no fluid leakage occurs between it and the piston rod 30 or piston head 36.

Figure 4:
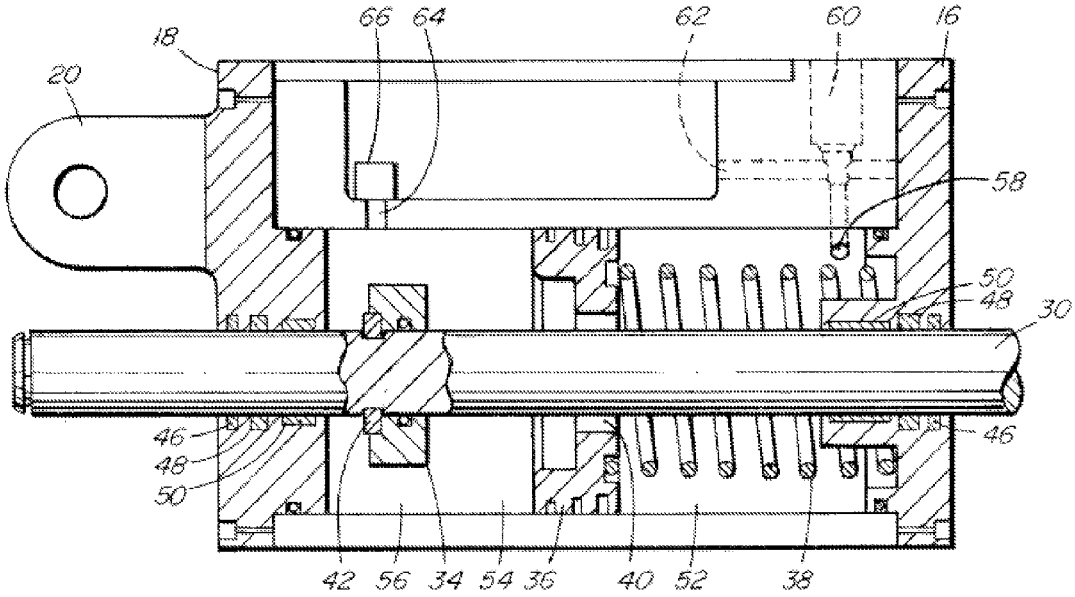
FIG. 4 is a longitudinal cross-sectional view of the controller.

Rear end cap 18 may also be provided with appropriate rod wipers 46, seals 48 and/or supports 50 to ensure that movement of the piston rod 30 does not push fluid out of, or pull contaminants into, the controller 10, and that the rod 30 is not deformed over time by the weight of the valve 34 or gravitational force. As best shown in FIG. 4, front end cap 16 may be similarly provided with appropriate rod wipers 46, seals 48 and/or supports 50.

Figure 3A:
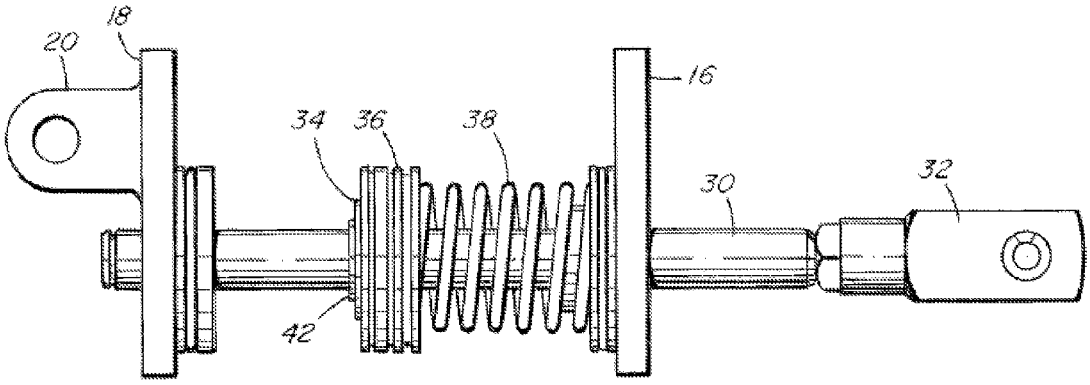
FIGS. 3*a*-3*c* are side views of the controller in three positions, with the outer casing removed.
Figure 3B:
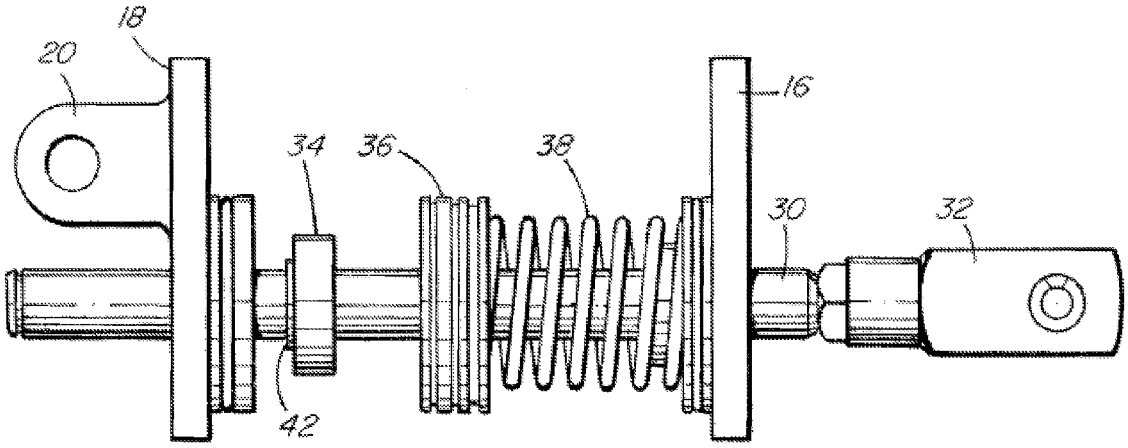
Figure 3C:
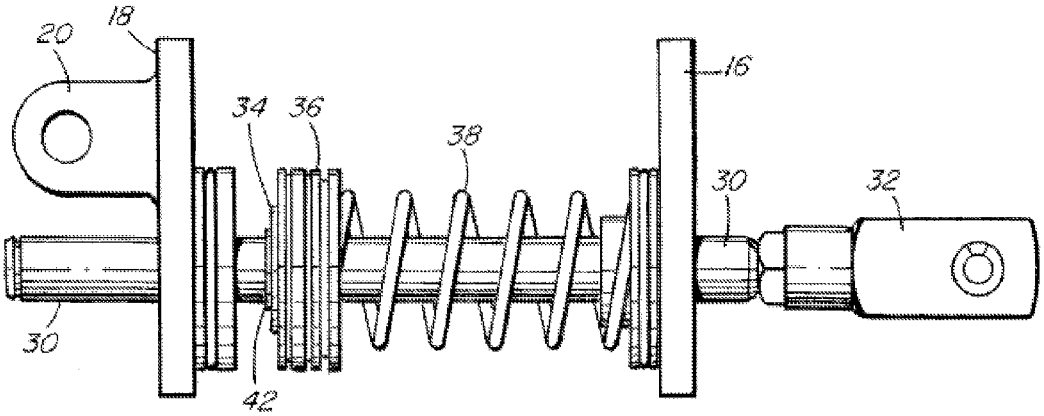

Referring now to FIGS. 3*a*-3*c*, the operation of the controller 10 is as follows. When the spring wing is in a closed position, it pulls piston rod 30 towards the front end cap 16 of the controller 10. In this position, the valve 34 contacts piston head 36, with spring 38 under some compressive pressure between the valve and the front end cap 16 of the controller 10, as shown in FIG. 3*a*. In the immediate time interval after a train car passes the spring wing and forces it open, the piston rod 30 moves towards the rear end cap 18, carrying valve 34 in the same direction and separating it from piston head 36, as shown in FIG. 3*b*. The hydraulic fluid pressure is approximately equal at both the front and rear sides of the piston head 36, avoiding a situation where movement of the piston rod is hampered by the pressure exerted by the incompressible fluid to the rear of the controller, and possibly retarding the rapid response of the spring wing. The movement of the piston rod 30 and valve 34 uncovers the central opening 40 (not shown), allowing fluid within the controller 10 to flow as necessary to maintain equal pressure on both sides of the piston head 36. The combined movement of the valve 34 away from piston head 36 and flow of the hydraulic fluid through central opening 40 releases the pressure on spring 38, allowing spring 38 to expand and push piston head 36 towards the rear end cap 18 until it meets valve 34, as shown in FIG. 3*c*. This closes central opening 40 (not shown) and prevents further fluid flow directly through piston head 36. Because there is now more fluid between the piston head 36 and the front end cap 16, the fluid pressure holds the piston rod 30 towards the rear end cap 18 of the controller 10, and therefore helps to retain the spring wing in an open position.

Figure 5:
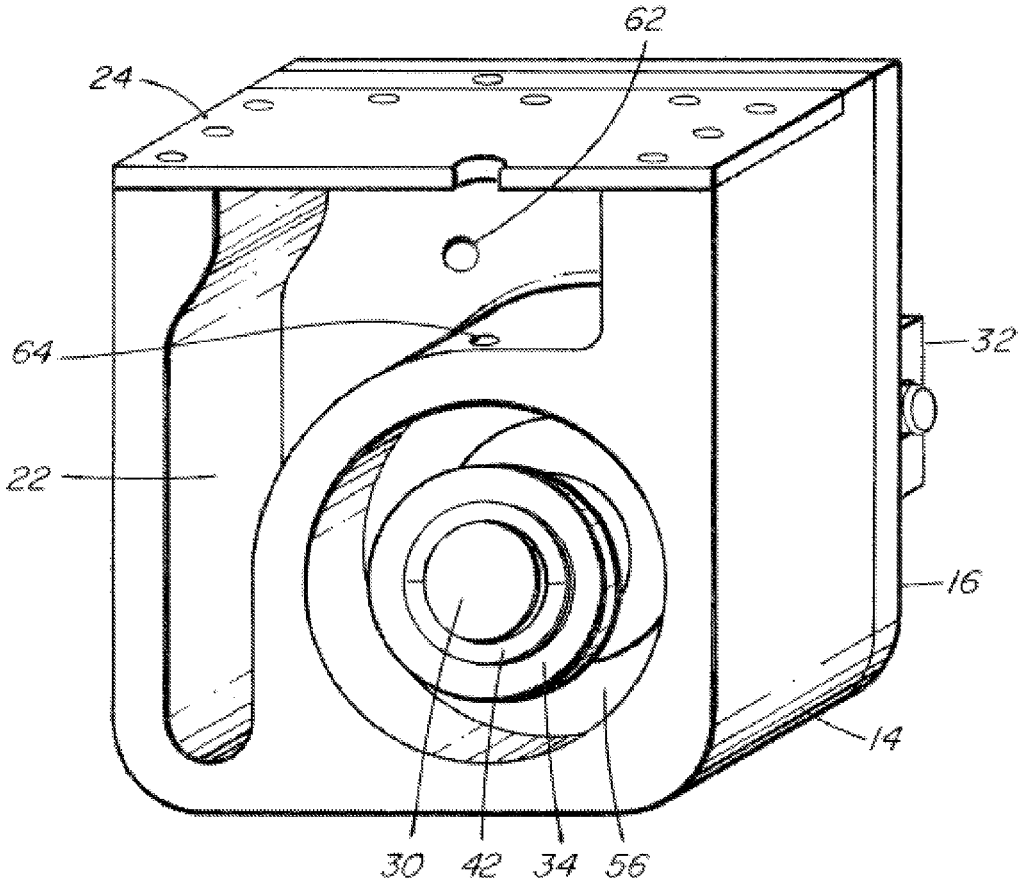
FIG. 5 is a lateral cross-sectional view of the controller.

FIGS. 4 and 5 show the hydraulic fluid flow path during operation of the controller 10. When valve 34 and piston head 36 are separated by movement of the piston rod 30, fluid within piston chamber 56 is free to move through central opening 40 in the piston head 36 from the rear side 54 of the piston head 36 to the front side 52. The size of the central opening 40, as well as the amount of space around the circumference of the valve 34, is sufficient that hydraulic fluid presents relatively little resistance to movement of the piston rod 30 and spring wing. This avoids a situation where the piston head 36 is forced to move against high pressure due to the fluid already on the rear side 54 of the chamber 52, under which the piston rod may be susceptible to buckling and/or failure.

Chamber outlet 58 in the front end 52 of the piston chamber 56 passes fluid to a flow metering device 60, such as a needle valve, timing circuit or other suitable device to control fluid flow out of the piston chamber 56. Flow metering device 60 may be adjustable, in order to allow the fluid flow rate through the metering device to be adjusted as needed to accommodate operative conditions such as the location of the frog, the size of the frog, and wear as the frog ages. Reservoir inlet 62 passes fluid from the metering device 60 into the internal reservoir 22.

Internal fluid reservoir 22 performs several functions. Because it stores extra hydraulic fluid, it may compensate for fluid volume changes, for example because of temperature changes, and for losses, such as through leakage or seepage. The reservoir 22 also manages unwanted foaming should aeration of the fluid occur. Finally, it acts as a settling tank for contaminates or particles that could collect in the system. Reservoir 22 is preferably provided with removable cover 24 for access to the reservoir for cleaning, refilling or other purposes.

Fluid passes from the reservoir 20 to the piston chamber 56 through a reservoir outlet 64, which is preferably fitted with a filter 66 to prevent contaminants from flowing into the piston chamber 56. It will be understood that the filter 66 may be provided at any inlet or outlet in the reservoir 22 or piston chamber 56, or at any point within the fluid flow path.

To expand further on the fluid flow mechanisms during operation of the controller 10, the fluid pressure within piston chamber 56 is approximately equal on either side 52, 54 of the piston head 36 when the spring wing is closed, as discussed earlier. The opening of the spring wing and associated piston rod movement separates the valve 34 and the piston head 36, increasing the pressure on the rear side 54 of the piston head 36. However, the separation of the valve 34 and piston head 36 exposes central opening 40, allowing fluid to flow to the front side 52 of the piston head 36. The removal of pressure exerted by the valve 34, as well as the decrease in fluid pressure on the rear side 54 of the piston head 36 allows the spring 38 to expand, pushing piston head 36 towards the rear end cap 18 of the controller 10 until it meets valve 34 and again seals central opening 40. At that point, there is a larger volume of fluid on the front side 52 of piston head 36 than on the rear side 54.

When the train cars have finished passing, and the spring wing tries to resume a closed position, it will exert pressure to pull piston rod 30 towards the front end cap 16, increasing the pressure in the front end of chamber 56. Fluid flows out of piston chamber 56 through chamber outlet 58, at a rate controlled by flow metering device 60, which decreases the pressure in the front of the chamber 56. However, the controlled rate of fluid flow means that the movement of the piston rod 30 is also controlled, which in turn controls the rate of closure of the spring wing.

Fluid then flows from the metering device 60 into the reservoir 22, where it may settle and/or be filtered, as described above, before re-entering the piston chamber 56 to equalize the pressure in the front and rear ends of the piston chamber 56, in preparation for the next spring wing actuation.

In the foregoing specification, the invention has been described with reference to specific embodiments thereof. However, the scope of the claims should not be limited by the preferred embodiments set forth in the examples, but should be given the broadest interpretation consistent with the description as a whole. The specification and drawings are, accordingly, to be regarded in an illustrative rather than a restrictive sense.

The invention claimed is:

1. A controller for a spring wing on a frog, comprising:

a casing comprising a body having front and rear end caps to define a piston chamber;

a piston rod operatively connected to and actuated by said spring wing, said piston rod passing through openings in said front and rear end caps;

a floating piston head having a central opening through which said piston rod passes; and a piston valve operatively attached to said piston rod and adapted to close said central opening.

2. The controller of claim 1 further comprising a fluid reservoir in fluid communication with said piston chamber, and a metering device to control fluid flow between said piston chamber and said fluid reservoir.

3. The controller of claim 2 further comprising a filter between said fluid reservoir and said piston chamber.

4. The controller of claim 2 further comprising a filter within said fluid reservoir.

5. The controller of claim 2 further comprising a removable cover for said fluid reservoir.

6. The controller of claim 2 wherein said metering device is adjustable.

7. The controller of claim 2 wherein said fluid reservoir is accessible from outside of said body.

8. The controller of claim 1 wherein at least one of said openings in said end caps further comprises a rod wiper to clean said piston rod.

9. The controller of claim 1 wherein at least one of said openings in said end caps further comprises a seal to prevent contaminants from entering said piston chamber or to prevent fluid from exiting said piston chamber.

10. The controller of claim 1 wherein at least one of said openings in said end caps further comprises a support to support said piston rod.

11. The controller of claim 1 further comprising a spring mounted on said front end cap to bias said piston head away from said front end cap.

12. The controller of claim 1 wherein said rear end cap comprises a connector to connect said casing in a switch.

13. A method of controlling a spring wing on a frog, comprising the steps of:

providing a controller comprising a body having front and rear end caps to define a piston chamber, and a piston rod passing through said front and rear end caps;

actuating said piston rod and a piston valve operatively connected to said piston rod toward said rear end cap, by movement of said spring wing to an open position, thereby separating said piston valve from contact with a floating piston head, exposing a central opening in said piston head and allowing hydraulic fluid within said piston chamber to pass through said central opening;

moving said floating piston head toward said rear end cap into contact with said piston valve, closing said central opening; and actuating said piston rod, said piston valve and said piston head toward said front end cap, by movement of said spring wing to a closed position.

14. The method of claim 13 further comprising the step of controlling fluid flow within said piston chamber to control a rate at which said spring wing moves to said closed position.

15. The method of claim 14 wherein said controller further comprises a fluid reservoir and a metering device, and wherein said step of controlling fluid flow comprises using said metering device to control fluid flow between said piston chamber and said fluid reservoir.

16. The method of claim 15 comprising the further step of filtering fluid within said fluid reservoir.

17. The method of claim 15 comprising the further step of filtering fluid between said fluid reservoir and said piston chamber.

18. The method of claim 15 comprising the further step of allowing contaminants within said fluid to settle within said fluid reservoir.

19. The method of claim 13 wherein said step of moving said piston head into contact with said piston valve comprises releasing a spring mounted between said front end cap and said piston head.

* * * * *